US012473117B2

(12) United States Patent
Lin et al.

(10) Patent No.: US 12,473,117 B2
(45) Date of Patent: Nov. 18, 2025

(54) COMPOSITE TRAY

(71) Applicant: AUO Corporation, Hsin-Chu (TW)

(72) Inventors: Chi-Chih Lin, Hsin-Chu (TW); Hsin-Chih Chen, Hsin-Chu (TW)

(73) Assignee: AUO CORPORATION, Hsin-Chu (TW)

( * ) Notice: Subject to any disclaimer, the term of this patent is extended or adjusted under 35 U.S.C. 154(b) by 97 days.

(21) Appl. No.: 18/541,493

(22) Filed: Dec. 15, 2023

(65) Prior Publication Data

US 2025/0058924 A1 Feb. 20, 2025

(30) Foreign Application Priority Data

Aug. 16, 2023 (TW) ..... 112130852

(51) Int. Cl.
*B65D 1/36* (2006.01)
*B65D 21/02* (2006.01)

(52) U.S. Cl.
CPC ..... *B65D 1/36* (2013.01); *B65D 21/0212* (2013.01)

(58) Field of Classification Search
CPC ..... B65D 1/36; B65D 21/0212; B65D 85/48; B65D 2585/6837; B65D 81/025; B65D 81/133; H01L 21/673; H01L 21/67326; H01L 21/6734
USPC ..... 206/521, 592, 593, 594, 449, 454
See application file for complete search history.

(56) References Cited

U.S. PATENT DOCUMENTS 5,564,805 A * 10/1996 Dickinson ..... B25H 3/023 206/508
5,833,057 A * 11/1998 Char ..... B65D 81/26 229/148
2007/0272590 A1* 11/2007 Tseng ..... H01L 21/67356 206/503

FOREIGN PATENT DOCUMENTS

| | | | |
|---|---|---|---|
| CN | 102320406 | A | 1/2012 |
| CN | 106315024 | A | 1/2017 |
| JP | 2009023699 | A | 2/2009 |
| TW | I500561 | B | 9/2015 |

OTHER PUBLICATIONS

Office Action issue by (TIPO) Taiwan Intellectual Property Office Ministry of Economic Affairs R.O.C., Apr. 29, 2024, 1 for Application No. 112130852, Tawian.

* cited by examiner

*Primary Examiner* — Orlando E Aviles
*Assistant Examiner* — Sanjidul Islam
(74) *Attorney, Agent, or Firm* — Tim Tingkang Xia, Esq.; Troutman Pepper Locke LLP

(57) ABSTRACT

A composite tray includes a tray body and an external supporting member. The tray body includes a loading plate and a plurality of side walls. The side walls protrude from the loading plate. The side walls and the loading plate jointly form an accommodating groove, and the accommodating groove has an opening. The external supporting member includes a supporting plate and a plurality of assembly members. The supporting plate is located in the accommodating groove and divides the accommodating groove into an inner space and an outer space. The inner space is located between the supporting plate and the loading plate. The outer space is located between the opening and the supporting plate. The assembly members are connected around the supporting plate and respectively assembled to the side (Continued)

walls, and a thickness of the supporting plate is less than a thickness of the loading plate.

13 Claims, 10 Drawing Sheets

COMPOSITE TRAY

CROSS-REFERENCE TO RELATED PATENT APPLICATION

This non-provisional application claims priority to and the benefit of, pursuant to 35 U.S.C. § 119 (a), patent application No. 112130852 filed in Taiwan on Aug. 16, 2023. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present disclosure relates to a tray, and particularly to a composite tray.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In the delivery process of electronic products (such as display panels or a liquid crystal glasses), to avoid the electronic products from impact and damage, the vendor generally loads the electronic products on a tray in a stacked manner, in order to produce buffer protection and increase the quantity of the electronic products being loaded.

However, with the increasing quantity of the electronic products being stacked, the risk of frictions or collisions between the electronic products increases, and the thickness of the bottom wall of the tray needs to be correspondingly increased to be sufficient to support the weight of the electronic products, thus increasing the manufacturing cost of the tray and the reducing the loading rate of the product.

SUMMARY

In view of the above, in one embodiment, a composite tray includes a tray body and an external supporting member. The tray body includes a loading plate and a plurality of side walls. The side walls protrude from the loading plate. The side walls and the loading plate jointly form an accommodating groove, and the accommodating groove has an opening. The external supporting member includes a supporting plate and a plurality of assembly members. The supporting plate is located in the accommodating groove and divides the accommodating groove into an inner space and an outer space. The inner space is located between the supporting plate and the loading plate. The outer space is located between the opening and the supporting plate. The assembly members are connected around the supporting plate and respectively assembled to the side walls, and a thickness of the supporting plate is less than a thickness of the loading plate.

In certain embodiments, the inner space accommodates a first loading object, the outer space accommodates a second loading object, the first loading object leans on the loading plate, and the second loading object leans on the supporting plate.

In certain embodiments, a gap exists between the first loading object and the supporting plate.

In certain embodiments, each of the side walls extends a stopping wall toward the accommodating groove, and the first loading object and the second loading object are limited between the stopping walls of the side walls.

In certain embodiments, each of the side walls has a snap slot, and each of the assembly members is snapped to the snap slot.

In certain embodiments, the snap slot has a slot wall, each of the assembly members is a U-shaped plate member having a first side plate, a second side plate and a connecting plate, the connecting plate is connected to one end of each of the first side plate and the second side plate away from the loading plate, an insertion slot is formed between the first side plate, the second side plate and the connecting plate, and the slot wall is inserted into the insertion slot.

In certain embodiments, a first included angle exists between the first side plate and the connecting plate, a second included angle exists between the second side plate and the connecting plate, and at least one of the first included angle and the second included angle is smaller than 90 degrees.

In certain embodiments, the composite tray further includes a cover body. The cover body is stacked on the tray body, the cover body has a positioning post, the positioning post is inserted into the snap slot of one of the side walls, and the positioning post abuts against a portion of a corresponding one of the assembly members located in the snap slot.

In certain embodiments, the first side plate of the corresponding one of the assembly members is located inside the snap slot, the positioning post has a side surface, and the side surface abuts against the first side plate.

In certain embodiments, a bottom end of the first side plate is connected to an extending plate, the positioning post has a bottom surface, and the bottom surface abuts against the extending plate.

In certain embodiments, the cover body is another tray body.

In certain embodiments, a material of the external supporting member is different from a material of the tray body.

In certain embodiments, a tensile strength, a compressive strength or a flexural strength of the external supporting member is greater than a tensile strength, a compressive strength or a flexural strength of the tray body.

In certain embodiments, a material density of the external supporting member is greater than a material density of the tray body.

In certain embodiments, the supporting plate of the external supporting member further has a reinforcing rib.

In sum, in the composite tray according to the embodiments of the present disclosure, the supporting plate of the external supporting member divides the accommodating groove into the inner space and the outer space. Further, the thickness of the supporting plate is less than the thickness of the loading plate of the tray body, such that the inner space and the outer space may respectively accommodate loading objects. Further, the loading object in the inner space leans on the loading plate, and the loading object in the outer space leans on the supporting plate. Thus, the thickness of the tray body does not need to be increased, thus reducing the manufacturing cost and enhancing the loading rate of the products. In addition, after the composite tray falls, the impact caused by the acceleration due to gravity sustained by the loading objects inside may be effectively reduced, thus significantly reducing the damage probability of the loading objects.

These and other aspects of the present disclosure will become apparent from the following description of the embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
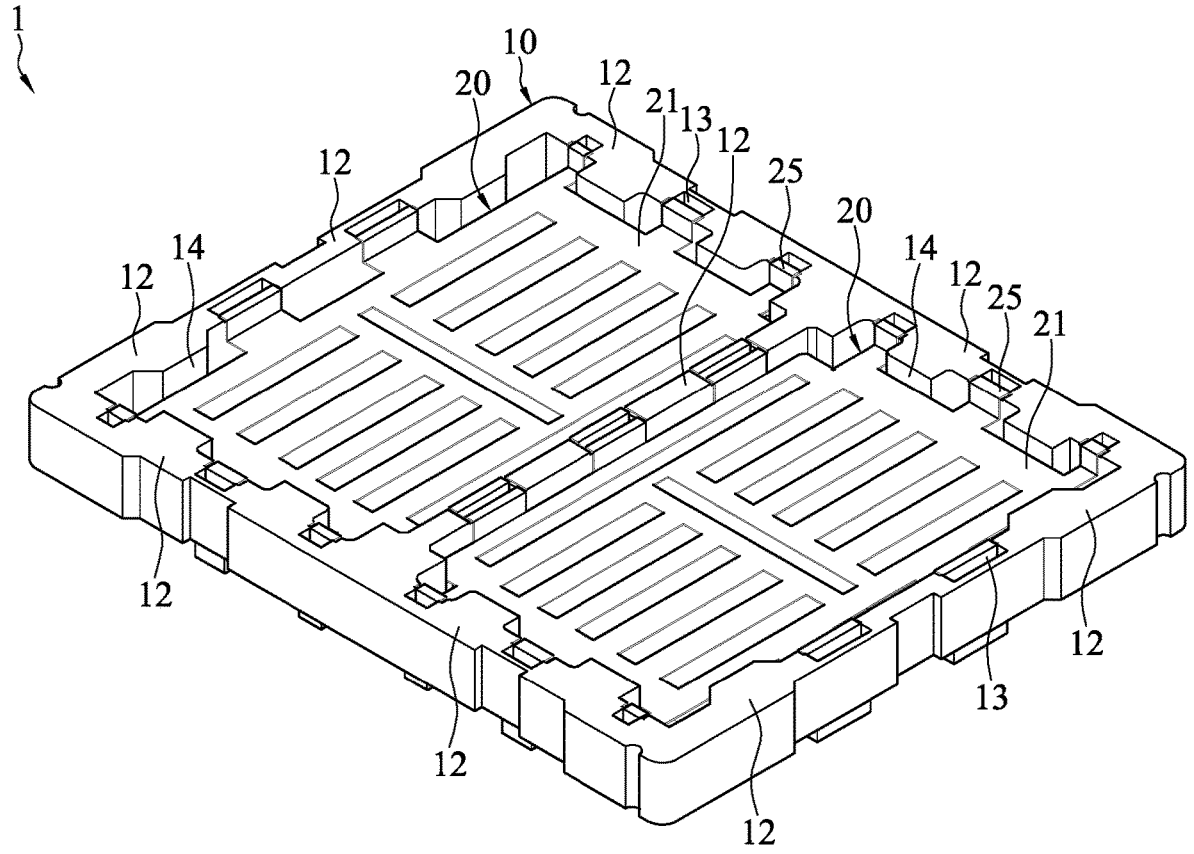
FIG. 1 is a perspective view of a composite tray according to one embodiment of the present disclosure.
Figure 2:
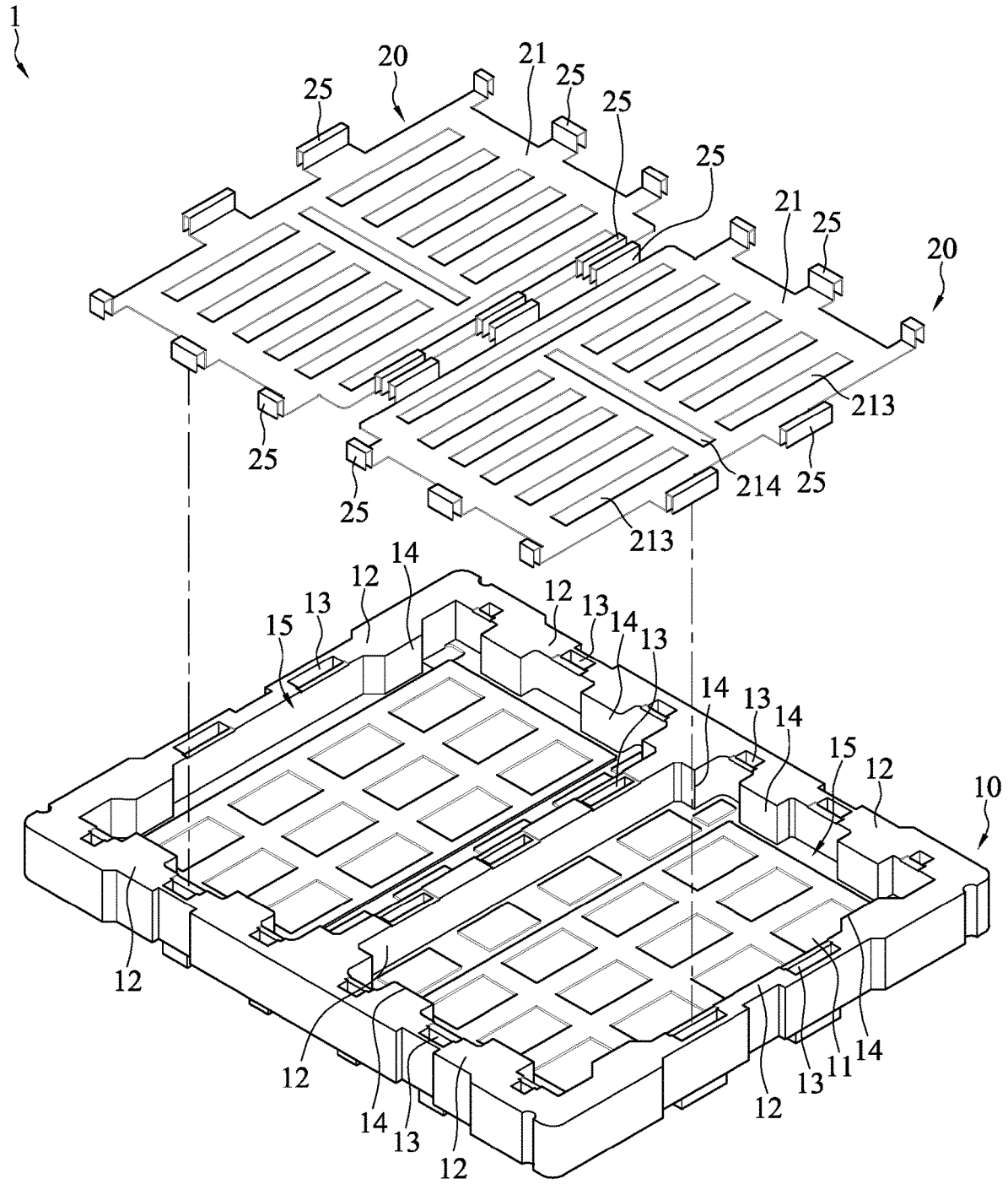
FIG. 2 is an exploded perspective view of a composite tray according to one embodiment of the present disclosure.
Figure 3:
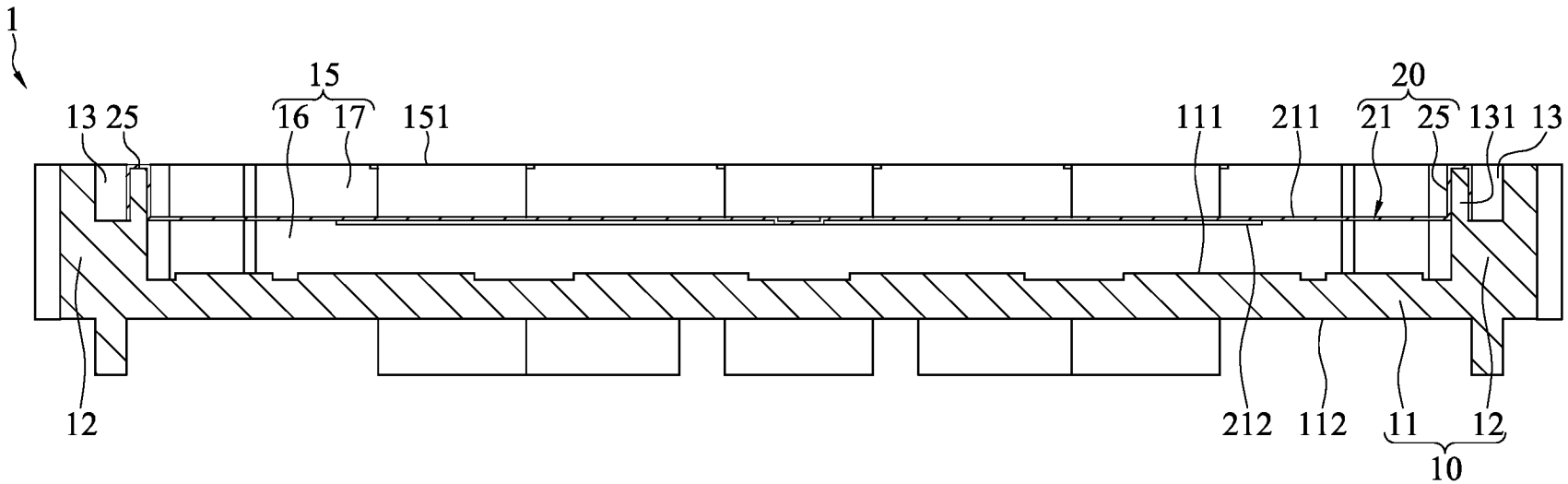
FIG. 3 is a sectional view of a composite tray according to one embodiment of the present disclosure.

FIG. 1 is a perspective view of a composite tray according to one embodiment of the present disclosure. FIG. 2 is an exploded perspective view of a composite tray according to one embodiment of the present disclosure. FIG. 3 is a sectional view of a composite tray according to one embodiment of the present disclosure. As shown in FIG. 1 and FIG. 2, the composite tray 1 in the present embodiment includes a tray body 10 and an external supporting member 20. The composite tray 1 is used to load various of objects. For example, the composite tray 1 may be used to load plate-shaped electronic products (such as display panels or liquid crystal glasses), without being limited thereto.

As shown in FIG. 1 to FIG. 3, the tray body 10 includes a loading plate 11 and a plurality of side walls 12. The side walls 12 protrude from a surface of the loading plate 11, and the side walls 12 and the loading plate 11 jointly form at least one accommodating groove 15. For example, as shown in FIG. 2, in the present embodiment, the side walls 12 and the loading plate 11 jointly form two accommodating grooves 15. Each accommodating groove 15 has an opening 151, and the loading objects (such as display panels or liquid crystal glasses) may be disposed into the accommodating groove 15 through the opening 151. However, the embodiment is exemplary, and the quantity of the side walls 12 of the tray body 10 and the quantity of the accommodating grooves 15 may be adjusted according to actual product needs.

In certain embodiments, the loading plate 11 and the side walls 12 of the tray body 10 may be an integrally-formed structure, and the material of the tray body 10 may be a buffer material to protect the loading objects accommodated in the accommodating grooves 15. For example, the buffer material may be a foam material, such as expanded polystyrene (EPS), expanded polypropylene (EPP), expanded polyethylene (EPE) or expanded ethylene polymer (EPO), etc.

As shown in FIG. 1 to FIG. 3, the quantity of the external supporting members 20 may correspond to the quantity of the accommodating grooves 15 of the tray body 10, and each external supporting member 20 is used to assemble the corresponding accommodating groove 15 and the side walls 12 located around the corresponding accommodating groove 15. Using one set of the accommodating groove 15 and the external supporting member 20 as an example, the external supporting member 20 includes a supporting plate 21 and a plurality of assembly members 25. The supporting plate 21 is located in the accommodating groove 15 and divides the accommodating groove 15 into an inner space 16 and an outer space 17. The inner space 16 is located between the supporting plate 21 and the loading plate 11, and the outer space 17 is located between the opening 151 of the accommodating groove 15 and the supporting plate 21. The assembly members 25 are connected around the supporting plate 21 and are detachably assembled to the side walls 12 around the accommodating groove 15.

In certain embodiments, each side edge of the supporting plate 21 may be connected to at least one assembly member 25. For example, as shown in FIG. 2, in the present embodiment, each side edge of the supporting plate 21 is connected to two or more assembly members 25, and the assembly members 25 are disposed at an interval, such that the external supporting member 20 may be more stable and less prone to shaking or deviation after being assembled to the side walls 12.

As shown in FIG. 3, a thickness of the supporting plate 21 of the external supporting member 20 is less than a thickness of the loading plate 11 of the tray body 10 to reduce the space being occupied by the supporting plate 21 in the accommodating groove 15, such that the accommodating groove 15 may accommodate loading objects with more quantity or larger volumes. In the present embodiment, the loading plate 11 has a loading surface 111 and a bottom surface 112. The loading surface 111 is used to contact and load the loading object accommodated in the inner space 16, and the bottom surface 112 is used to load the object leaned at the outer portion of the tray body 10. The thickness of the loading plate 11 refers to the thickness between the loading surface 111 and the bottom surface 112. The supporting plate 21 has a supporting surface 211 and a bottom surface 212. The supporting plate 211 is used to contact and load the loading object accommodated in the outer space 17, and the bottom surface 212 is the surface of the supporting plate 21 closest to the loading plate 11. The thickness of the supporting plate 21 refers to the thickness between the supporting surface 211 and the bottom surface 212.

However, the previous embodiment is exemplary, and in certain embodiments, the thickness of the loading plate 11 may refer to a maximum thickness, a minimum thickness of an average thickness of the loading plate 11, and the thickness of the supporting plate 12 may refer to a maximum thickness, a minimum thickness of an average thickness of the supporting plate 12.

In certain embodiments, the supporting plate 21 of the assembly members 25 of the external supporting member 20 may be integrally-formed structures, and a material of the external supporting member 20 may be different from a material of the tray body 10. Further, a strength (such as a compressive strength or a flexural strength) of the external supporting member 20 may be greater than a strength (such as a tensile strength, a compressive strength or a flexural strength) of the tray body 10, or a material density of the external supporting member 20 may be greater than a material density of the tray body 10, such that the external supporting member 20 may sustain greater pressure without easily breaking, deforming or being damaged relative to the tray body 10. Thus, even though the thickness of the supporting plate 21 of the external supporting member 20 is less than the thickness of the loading plate 11 of the tray body 10, the supporting plate 21 may provide good weight supporting capability.

Continuing from above, for example, the tray body 10 is made of a foam material, and a density of the foam material is generally between 0.02 to 0.7 g/cm$^3$. The external supporting member 20 may be made of a metal material or a plastic material, where the metal material may be a material such as iron, aluminum or steel, etc., that has a density greater than 2 g/cm$^3$, and the plastic material may be a PET material (with a density of about 1.3 to 1.4 g/cm$^3$), an ABS material (with a density of about 1.06 g/cm$^3$) or a PC material (with a density of about 1.2 g/cm$^3$), such that the strength and the material density of the external supporting member 20 are both greater than the strength and the material density of the tray body 10.

Thus, in the composite tray 1 according to the embodiments of the present disclosure, the external supporting member 20 divides the accommodating groove 15 into the inner space 16 and the outer space 17, such that the inner space 16 and the outer space 17 may respectively accommodate loading objects. Further, the loading object in the inner space 16 leans on the loading plate 11, that is, the loading plate 11 is used to support the loading object in the inner space 16. The loading object in the outer space 17 leans on the supporting plate 21, that is, the supporting plate 21 is used to support the loading object in the outer space 17. Thus, the loading plate 11 does not need to individually sustain the weights of all of the loading objects, and the thickness of the loading plate 11 does not need to be increased, thus reducing the manufacturing cost and enhancing the loading rate of the products.

Figure 4:
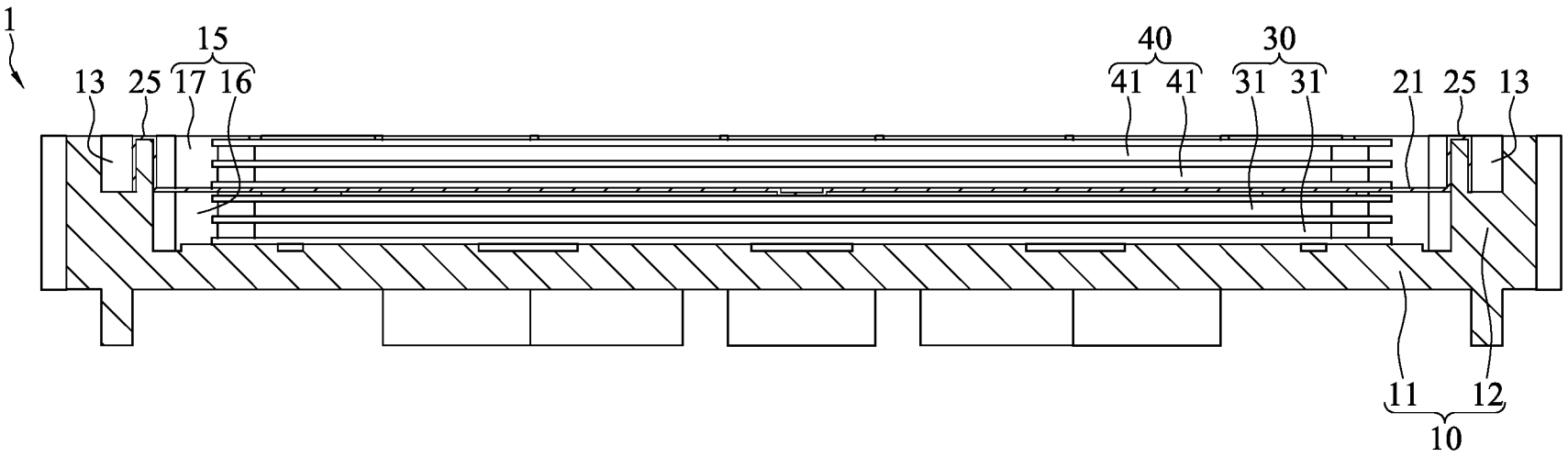
FIG. 4 is a sectional view of a composite tray loading objects according to one embodiment of the present disclosure.

Specifically, FIG. 4 is a sectional view of a composite tray loading objects according to one embodiment of the present disclosure. As shown in FIG. 4, in the present embodiment, the inner space 16 accommodates a first loading object 30, the first loading object 30 includes two first panels 31 stacked to each other, and the first loading object 30 leans on the loading plate 11. The outer space 17 accommodates a second loading object 40, the second loading object 40 includes two second panels 41 stacked to each other, and the second loading object 40 leans on the supporting plate 21 of the external supporting member 20. A gap exists between the first loading object 30 in the inner space 16 and the supporting plate 21, so the first loading object 30 and the second loading object 40 are separated from each other without being stacked to each other, and the weights of the first loading object 30 and the second loading object 40 do not concentrate on the loading plate 11 of the tray body 10. Thus, the thickness of the loading plate 11 of the tray body 10 does not need to be increased, and the composite tray 1 may accommodate a plurality of panels, thus reducing the material usage and reducing the manufacturing cost.

Figure 5:
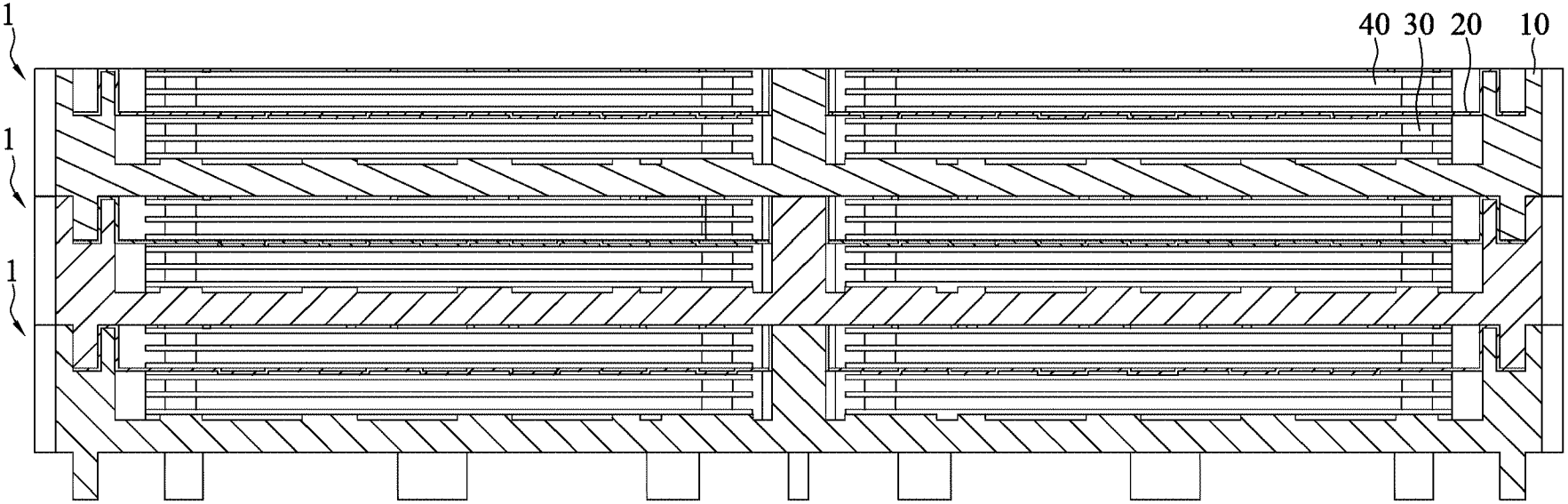
FIG. 5 is a schematic view of a plurality of composite trays stacked together according to one embodiment of the present disclosure.

Further, referring to FIG. 4 and FIG. 5, FIG. 5 is a schematic view of a plurality of composite trays stacked together according to one embodiment of the present disclosure. As described above, the thickness of the loading plate 11 of the tray body 10 does not need to be increased. Thus, during delivery or storage, the stacked quantity of the composite tray 1 may correspondingly increase, thus increasing the loading rate of the product. In addition, the first loading object 30 and the second loading object 40 are separated from each other without being stacked to each other. Thus, after the composite tray 1 falls, the impact caused by the acceleration due to gravity sustained by the loading objects in the accommodating groove 15 may be effectively reduced, thus significantly reducing the damage probability of the loading objects.

Further, as shown in FIG. 2, the supporting plate 21 of the external supporting member 20 may further have at least one reinforcing rib, thus further increasing the structural strength (such as the tensile strength, the compressive strength or the flexural strength) of the supporting plate 21 to have better weight supporting capability. In the present embodiment, the supporting plate 21 has a plurality of elongated-shaped first reinforcing ribs 213 and an elongated-shaped second reinforcing rib 214. The first reinforcing ribs 213 are arranged in two columns, the second reinforcing rib 214 is located between the two columns of the first reinforcing ribs 213, and a first extending direction of each first reinforcing rib 213 is different from a second extending direction of the second reinforcing rib 214 (and in this case, the first extending direction and the second extending direction are perpendicular to each other), such that the supporting plate 21 is reinforced in different directions.

Figure 6:
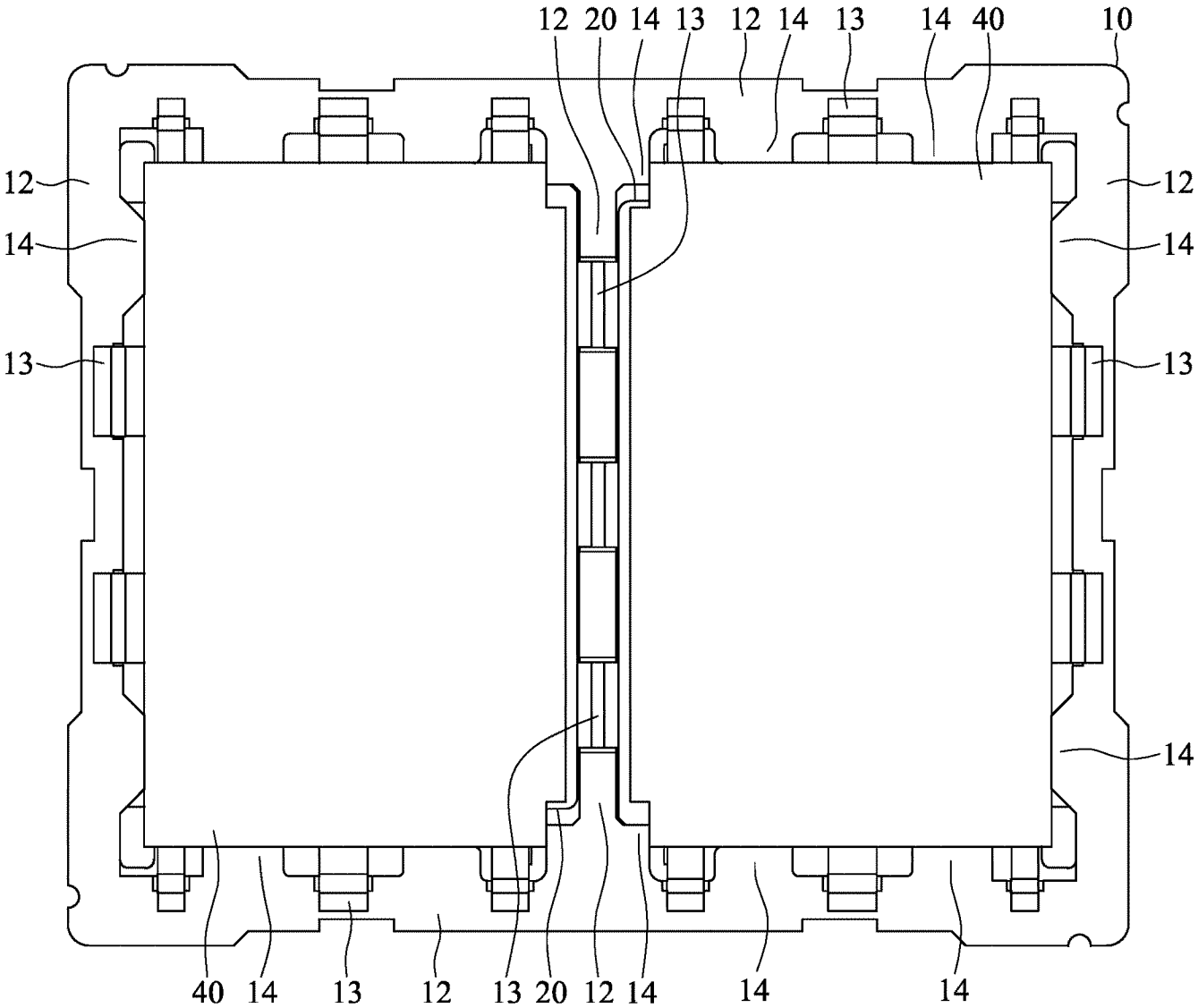
FIG. 6 is a top view of a composite tray according to one embodiment of the present disclosure.

FIG. 6 is a top view of a composite tray according to one embodiment of the present disclosure. Referring to FIG. 2, FIG. 4 and FIG. 6, each side wall 12 of the tray body 10 may extend at least one stopping wall 14 toward the accommodating groove 15, and the side wall 12 and the stopping walls 14 are integrally formed structures. The first loading object 30 and the second loading object 40 are limited between the stopping walls 14, thus achieving the buffering effect that avoids the first loading object 30 and the second loading object 40 from the impact by an external force in the delivery process. In addition, in the present embodiment, each side wall 12 of the tray body 10 extends at least two stopping walls 14, and the stopping walls 14 are configured at intervals, such that each side of the first loading object 30 and the second loading object 40 may be limited at multiple points to enhance the buffering effect.

In certain embodiments, the assembly members 25 of the external supporting member 20 may be detachably assembled to the side walls 12 of the tray body 10 by methods such as snapping, engaging or clamping, etc. For example, as shown in FIG. 2 and FIG. 3, in the present embodiment, each side wall 12 of the tray body 10 has at least one snap slot 13. The quantity and the locations of the snap slots 13 correspond to the quantity and the locations of the assembly members 25 of the external supporting member 20, and each assembly member 25 is snapped to each snap slot 13, such that the external supporting member 20 is detachably assembled to the tray body 10.

Figure 7:
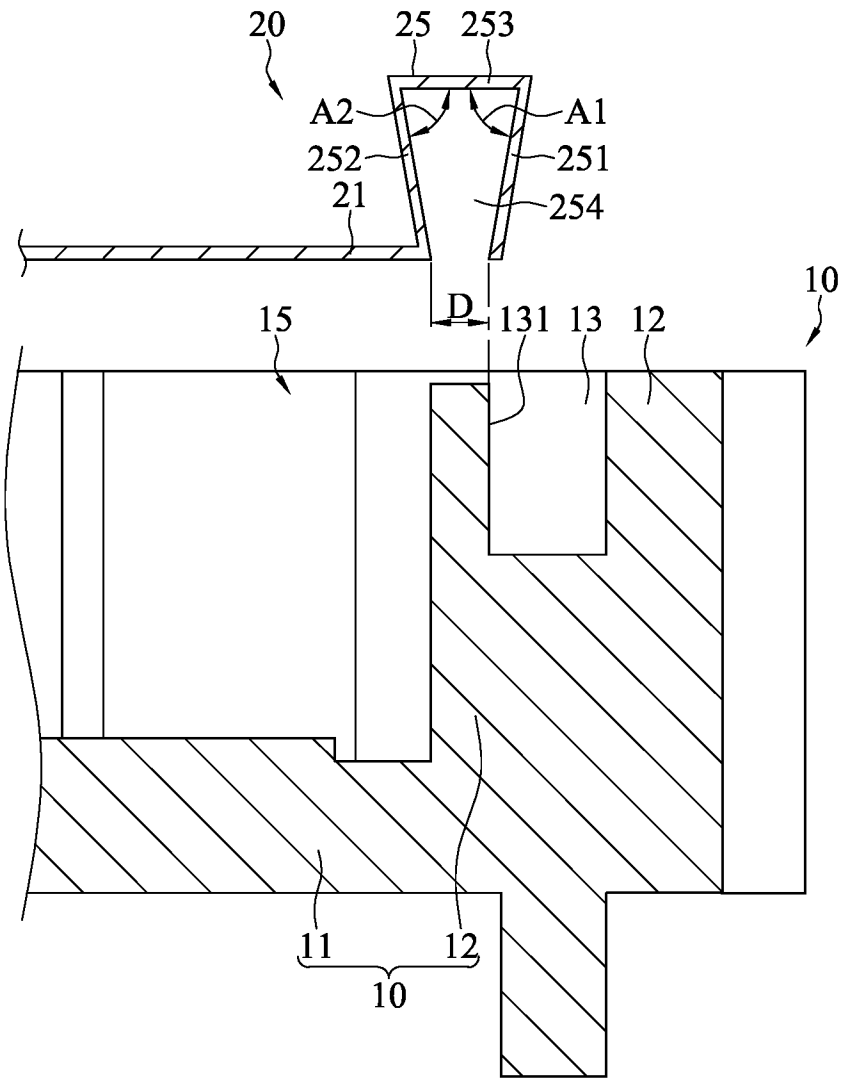
FIG. 7 is a partially enlarged sectional view of a composite tray according to one embodiment of the present disclosure.

FIG. 7 is a partially enlarged sectional view of a composite tray according to one embodiment of the present disclosure. Referring to FIG. 3 and FIG. 7, in the present embodiment, each snap slot 13 of the tray body 10 has a slot wall 131, and each assembly member 25 of the external supporting member 20 is a U-shaped plate member having a first side plate 251, a second side plate 252 and a connecting plate 253. The connecting plate 253 is connected to one end of each of the first side plate 251 and the second side plate 252 away from the loading plate 11, such that a U-shaped insertion slot 254 is formed between the first side plate 251, the second side plate 252 and the connecting plate 253. The slot wall 131 of each snap slot 13 is correspondingly inserted into the insertion slot 254 of each assembly member 25, such that each assembly member 25 snaps to each snap slot 13.

Further, as shown in FIG. 7, in each assembly member 25 of the external a first included angle A1 exists between the first side plate 251 and the connecting plate 253, and a second included angle A2 exists between the second side plate and the connecting plate. At least one of the first included angle A1 and the second included angle A2 is smaller than 90 degrees, such that after the slot wall 131 of each snap slot 13 is inserted into the insertion slot 254 of each assembly member 25, the first side plate 251 and the second side plate 252 may clamp the slot wall 131 of each snap slot 13, thus reinforcing the fixing effect. In the present embodiment, the first included angle A1 and the second included angle A2 of each assembly member 25 are both smaller than 90 degrees, and an interval distance D between the end portion of the first side plate 251 close to the loading plate 11 and the end portion of the second side plate 252 close to the loading plate 11 is less than the thickness of the slot wall 131 of each snap slot 13, thus increasing the strength of the first side plate 251 and the second side plate 252 clamping the slot wall 131 and further reinforcing the fixing effect.

However, the previous embodiment is exemplary, and in certain embodiments, the first included angle A1 between the first side plate 251 and the connecting plate 253 and the second included angle A2 between the second side plate 252 and the connecting plate 253 of each assembly member 25 may be both 90 degrees.

Figure 8:
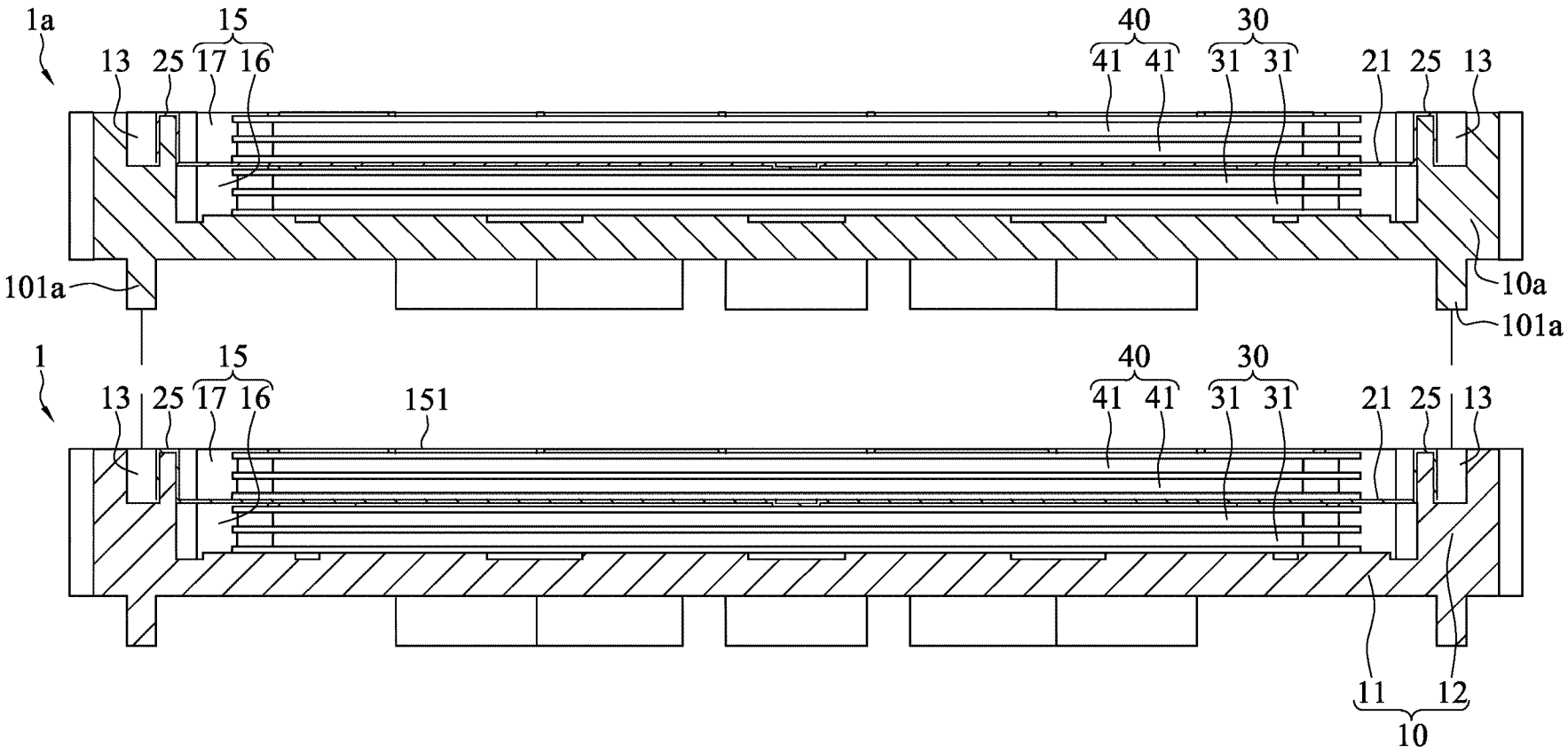
FIG. 8 is an exploded sectional view of a plurality of tray bodies of a composite tray according to one embodiment of the present disclosure.
Figure 9:
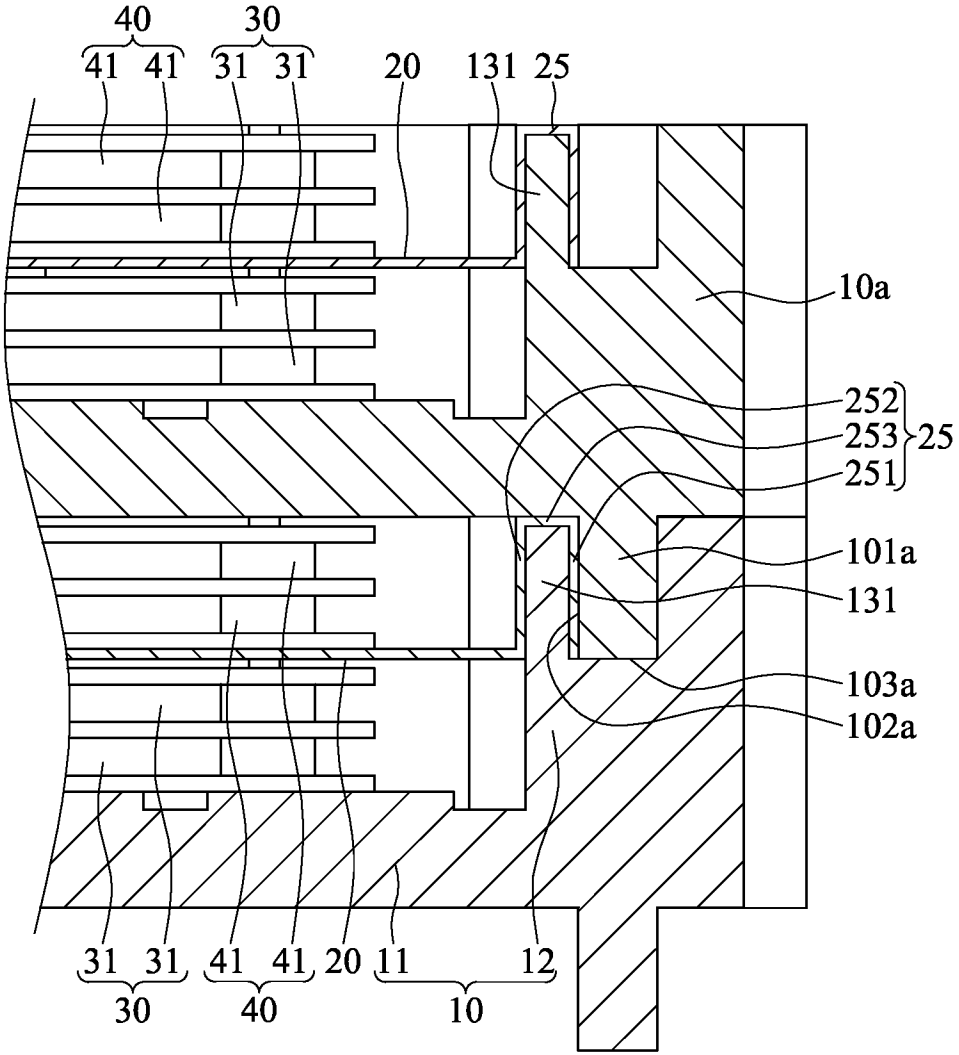
FIG. 9 is a stacked sectional view of a plurality of tray bodies of a composite tray according to one embodiment of the present disclosure.

FIG. 8 is an exploded sectional view of a plurality of tray bodies of a composite tray according to one embodiment of the present disclosure. FIG. 9 is a stacked sectional view of a plurality of tray bodies of a composite tray according to one embodiment of the present disclosure. As shown in FIG. 8 and FIG. 9, the composite tray 1 further includes a cover body, and the cover body is stacked on the tray body 10 to cover the opening 151 of the accommodating groove 15 of the tray body 10. In the present embodiment, the cover body is a tray body 10*a* of another composite tray 1*a*, and the bottom portion of the tray body 10*a* has at least one positioning post 101*a*. The positioning post 101*a* is used to be inserted into at least one snap slot 13 of the side walls 12, and a portion of the corresponding assembly member 25 located in the snap slot 13 is subjected to abutting of the positioning post 101*a*, such that the composite trays 1, 1*a*, after being stacked, may be fixed to each other by the positioning post 101*a* to prevent easy separation, and the corresponding assembly member 25 of the external supporting member 20 may be subjected to abutting of the positioning post 101*a*, thus reinforcing the fixing effect with the external supporting member 20 and the tray body 10.

Figure 10:
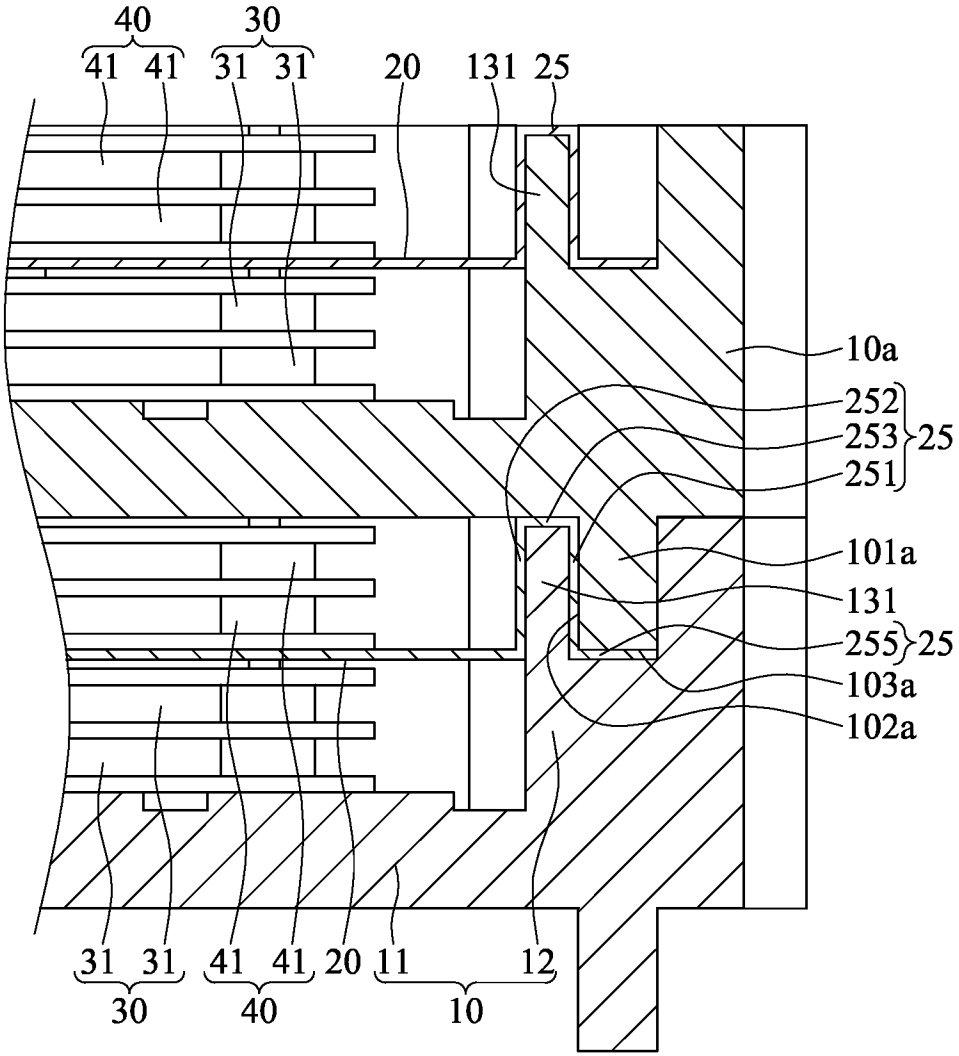
FIG. 10 is another stacked sectional view of a plurality of tray bodies of a composite tray according to one embodiment of the present disclosure.

Further referring to FIG. 8 and FIG. 9, in the present embodiment, the first side plate 251 of the assembly member 25 of the external supporting member 20, and the positioning post 101*a* of the tray body 10*a* has a side surface 102*a*. The side surface 102*a* abuts against the first side plate 251, such that the first side plate 251 may tightly lean on the slot wall 131 of the snap slot 13 to reinforce the positioning effect. Alternatively, FIG. 10 is another stacked sectional view of a plurality of tray bodies of a composite tray according to one embodiment of the present disclosure. As shown in FIG. 10, in another embodiment, the bottom end of the first side plate 251 located in the snap slot 13 is integrally connected to an extending plate 255, and the positioning post 101*a* has a bottom surface 103*a*. The bottom surface 103*a* abuts against the extending plate 255, such that the first side plate 251 and the extending plate 255 may be simultaneously subjected to the abutting of the positioning post 101*a* to reinforce the positioning effect.

In sum, in the composite tray 1 according to the embodiments of the present disclosure, the supporting plate 21 of the external supporting member 20 divides the accommodating groove 15 into the inner space 16 and the outer space 17. Further, the thickness of the supporting plate 21 is less than the thickness of the loading plate 11 of the tray body 10, such that the inner space 16 and the outer space 17 may respectively accommodate loading objects. Further, the loading object in the inner space 16 leans on the loading plate 11, and the loading object in the outer space 17 leans on the supporting plate 21. Thus, the thickness of the tray body 10 does not need to be increased, thus reducing the manufacturing cost and enhancing the loading rate of the products. In addition, after the composite tray 1 falls, the impact caused by the acceleration due to gravity sustained by the loading objects inside may be effectively reduced, thus significantly reducing the damage probability of the loading objects.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A composite tray, comprising:

a tray body, comprising a loading plate and a plurality of side walls, wherein the side walls protrude from the loading plate, the side walls and the loading plate jointly form an accommodating groove, each of the side walls has a snap slot, and the accommodating groove has an opening;

an external supporting member, comprising a supporting plate and a plurality of assembly members, wherein the supporting plate is located in the accommodating groove and divides the accommodating groove into an inner space and an outer space, the inner space is located between the supporting plate and the loading plate, the outer space is located between the opening and the supporting plate, the assembly members are connected around the supporting plate and respectively assembled to the side walls, each of the assembly members is snapped to the snap slot of a corresponding one of the side walls, and a thickness of the supporting plate is less than a thickness of the loading plate; and a cover body, stacked on the tray body, wherein the cover body has a positioning post, the positioning post is inserted into the snap slot of one of the side walls, and the positioning post abuts against a portion of a corresponding one of the assembly members located in the snap slot.

2. The composite tray according to claim 1, wherein the inner space accommodates a first loading object, the outer space accommodates a second loading object, the first loading object leans on the loading plate, and the second loading object leans on the supporting plate.

3. The composite tray according to claim 2, wherein a gap exists between the first loading object and the supporting plate.

4. The composite tray according to claim 2, wherein each of the side walls extends a stopping wall toward the accommodating groove, and the first loading object and the second loading object are limited between the stopping walls of the side walls.

5. The composite tray according to claim 1, wherein the snap slot has a slot wall, each of the assembly members is a U-shaped plate member having a first side plate, a second side plate and a connecting plate, the connecting plate is connected to one end of each of the first side plate and the second side plate away from the loading plate, an insertion slot is formed between the first side plate, the second side plate and the connecting plate, and the slot wall is inserted into the insertion slot.

6. The composite tray according to claim 5, wherein a first included angle exists between the first side plate and the connecting plate, a second included angle exists between the second side plate and the connecting plate, and at least one of the first included angle and the second included angle is smaller than 90 degrees.

7. The composite tray according to claim 5, wherein the first side plate of the corresponding one of the assembly members is located inside the snap slot, the positioning post has a side surface, and the side surface abuts against the first side plate.

8. The composite tray according to claim 7, wherein a bottom end of the first side plate is connected to an extending plate, the positioning post has a bottom surface, and the bottom surface abuts against the extending plate.

9. The composite tray according to claim 5, wherein the cover body is another tray body.

10. The composite tray according to claim 1, wherein a material of the external supporting member is different from a material of the tray body.

11. The composite tray according to claim 10, wherein a tensile strength, a compressive strength or a flexural strength of the external supporting member is greater than a tensile strength, a compressive strength or a flexural strength of the tray body.

12. The composite tray according to claim 10, wherein a material density of the external supporting member is greater than a material density of the tray body.

13. The composite tray according to claim 1, wherein the supporting plate of the external supporting member further has a reinforcing rib.

* * * * *